US011160324B2

(12) United States Patent
Fuerst, Jr. et al.

(10) Patent No.: US 11,160,324 B2
(45) **Date of Patent: *Nov. 2, 2021**

(54) FOOTWEAR ARTICLE HAVING CORD STRUCTURE

(71) Applicant: Fuerst Group, Inc., Menlo Park, CA (US)

(72) Inventors: Rory Fuerst, Jr., Portland, OR (US); Stefano Del Biondi, Noventa Padovana (IT)

(73) Assignee: Fuerst Group, Inc., Menlo Park, CA (US)

( * ) Notice: Subject to any disclaimer, the term of this patent is extended or adjusted under 35 U.S.C. 154(b) by 268 days.

This patent is subject to a terminal disclaimer.

(21) Appl. No.: 16/512,290

(22) Filed: Jul. 15, 2019

(65) Prior Publication Data

US 2019/0335846 A1 Nov. 7, 2019

Related U.S. Application Data

(63) Continuation of application No. 15/410,676, filed on Jan. 19, 2017, now Pat. No. 10,390,584.
(Continued)

(51) Int. Cl.
*A43B 3/26* (2006.01)
*A43B 13/04* (2006.01)
(Continued)

(52) U.S. Cl.
CPC ..... *A43B 3/26* (2013.01); *A43B 1/04* (2013.01); *A43B 3/00* (2013.01); *A43B 13/04* (2013.01);
(Continued)

(58) Field of Classification Search
CPC .. A43B 3/26; A43B 3/00; A43B 3/223; A43B 3/242; A43B 1/04; A43B 23/00;
(Continued)

(56) References Cited

U.S. PATENT DOCUMENTS 687,513 A 11/1901 Bibikov
1,536,839 A 5/1925 Gillis
(Continued)

FOREIGN PATENT DOCUMENTS

CH 132292 4/1929
FR 616246 1/1927
(Continued)

OTHER PUBLICATIONS

Japanese Patent Office, Office Action Issued in Application No. 2017-007392, dated Dec. 22, 2020, 15 pages.
(Continued)

*Primary Examiner* — Shaun R Hurley
*Assistant Examiner* — Bao-Thieu L Nguyen
(74) *Attorney, Agent, or Firm* — McCoy Russell LLP

(57) ABSTRACT

A footwear article is provided herein. The footwear article may include a cord structure including interconnected bights in a vamp cord and a rand cord forming a loop line extending along at least a portion of the footwear article, and further including an anchor cord extending along the portion of the footwear article and parallel to the loop line. The rand cord may couple to the anchor cord. In this way, the cord structure may be tensioned independently of other upper materials.

20 Claims, 3 Drawing Sheets

Related U.S. Application Data

(60) Provisional application No. 62/280,663, filed on Jan. 19, 2016.

(51) Int. Cl.

| | |
|---|---|
| ***A43B 23/02*** | (2006.01) |
| ***A43C 1/04*** | (2006.01) |
| ***A43B 1/04*** | (2006.01) |
| ***A43B 3/00*** | (2006.01) |
| ***A43B 13/22*** | (2006.01) |
| ***A43B 23/00*** | (2006.01) |

(52) U.S. Cl.
CPC ..... *A43B 13/223* (2013.01); *A43B 23/00* (2013.01); *A43B 23/027* (2013.01); *A43B 23/0275* (2013.01); *A43B 23/0295* (2013.01); *A43C 1/04* (2013.01)

(58) Field of Classification Search
CPC ..... A43B 23/0295; A43B 23/027; A43B 23/0275; A43B 23/0245; A43B 13/223; A43B 13/04
See application file for complete search history.

(56) References Cited

U.S. PATENT DOCUMENTS

| | | | |
|---|---|---|---|
| 1,600,621 | A | 9/1926 | Buek, Jr. |
| 1,717,183 | A | 6/1929 | Brenner |
| 1,877,080 | A | 9/1932 | Teshima |
| D91,999 | S | 4/1934 | Heilbrunn |
| D95,204 | S | 4/1935 | Haflin |
| 2,143,556 | A | 1/1939 | Hodaly |
| RE21,392 | E | 3/1940 | Hurwit |
| 2,551,723 | A | 5/1951 | Camero |
| D164,847 | S | 10/1951 | Dronoff |
| 2,675,631 | A | 4/1954 | Doughty |
| 3,067,532 | A | 12/1962 | Peterson |
| 3,193,948 | A | 7/1965 | Roberts |
| 3,471,948 | A | 10/1969 | Nadler |
| 4,438,574 | A | 3/1984 | Johnson |
| D278,947 | S | 5/1985 | Foldes |
| D351,275 | S | 10/1994 | Hatfield et al. |
| 5,692,319 | A | 12/1997 | Parker et al. |
| D391,068 | S | 2/1998 | Aveni et al. |
| D393,360 | S | 4/1998 | Aveni et al. |
| 6,029,376 | A | 2/2000 | Cass |
| 6,052,921 | A | 4/2000 | Oreck |
| 6,449,879 | B1 | 9/2002 | Fallon et al. |
| D467,723 | S | 12/2002 | Gerber et al. |
| 7,204,042 | B2 | 4/2007 | Aveni |
| 7,293,371 | B2 | 11/2007 | Aveni |
| 7,540,097 | B2 | 6/2009 | Greene et al. |
| 7,703,220 | B2 | 4/2010 | Aveni |
| 7,774,884 | B2 | 8/2010 | Greene et al. |
| 8,051,581 | B2 | 11/2011 | Aveni |
| 8,065,818 | B2 | 11/2011 | Greene et al. |
| D737,561 | S | 9/2015 | Aveni et al. |
| D769,590 | S | 10/2016 | Aveni et al. |
| D798,565 | S | 10/2017 | Aveni et al. |
| 10,092,060 | B2 | 10/2018 | Aveni et al. |
| 10,390,584 | B2 * | 8/2019 | Fuerst, Jr. ..... A43B 13/04 |
| 2005/0055844 | A1 | 3/2005 | Yu |
| 2006/0059715 | A1 | 3/2006 | Aveni |
| 2006/0248749 | A1 | 11/2006 | Ellis |
| 2007/0068041 | A1 | 3/2007 | Farys |
| 2007/0180730 | A1 | 8/2007 | Greene et al. |
| 2008/0083137 | A1 | 4/2008 | Aveni |
| 2008/0289214 | A1 | 11/2008 | Aveni |
| 2009/0071041 | A1 | 3/2009 | Hooper |
| 2010/0107346 | A1 | 5/2010 | Aveni |
| 2010/0107442 | A1 | 5/2010 | Hope et al. |
| 2010/0154256 | A1 | 6/2010 | Dua |
| 2011/0041359 | A1 | 2/2011 | Dojan et al. |
| 2011/0119956 | A1 | 5/2011 | Borel et al. |
| 2011/0271556 | A1 | 11/2011 | Dillenbeck |
| 2012/0017468 | A1 | 1/2012 | Dojan et al. |
| 2012/0066931 | A1 | 3/2012 | Dojan et al. |
| 2012/0246973 | A1 | 10/2012 | Dua |
| 2014/0000127 | A1 | 1/2014 | Tang |
| 2014/0130372 | A1 | 5/2014 | Aveni et al. |
| 2014/0196311 | A1 | 7/2014 | Follet et al. |
| 2014/0223779 | A1 | 8/2014 | Elder et al. |
| 2014/0245633 | A1 | 9/2014 | Podhajny |
| 2015/0047225 | A1 | 2/2015 | Zavala et al. |
| 2015/0201707 | A1 | 7/2015 | Bruce |
| 2015/0282565 | A1 | 10/2015 | Kilgore |
| 2015/0320139 | A1 | 11/2015 | Peitzker |
| 2015/0342293 | A1 | 12/2015 | Hazzouri |
| 2016/0058099 | A1 | 3/2016 | Panian et al. |
| 2016/0088899 | A1 | 3/2016 | Liles et al. |
| 2016/0206044 | A1 | 7/2016 | Dimoff et al. |
| 2016/0345675 | A1 | 12/2016 | Bruce et al. |
| 2017/0020231 | A1 | 1/2017 | Hausmann et al. |
| 2017/0035149 | A1 | 2/2017 | Bruce et al. |
| 2017/0105486 | A1 | 4/2017 | Klen et al. |
| 2017/0105487 | A1 | 4/2017 | Klein |
| 2017/0202295 | A1 | 7/2017 | MacGilbert et al. |
| 2017/0347754 | A1 | 12/2017 | Fuerst, Jr. et al. |
| 2018/0295942 | A1 | 10/2018 | Drake |

FOREIGN PATENT DOCUMENTS

| | | | |
|---|---|---|---|
| FR | 1027754 | | 5/1953 |
| FR | 1055620 | | 2/1954 |
| JP | 3038372 | U | 6/1997 |
| JP | 2002219002 | A | 8/2002 |
| JP | 2015533620 | A | 11/2015 |
| KR | 1998068775 | U | 12/1998 |
| NL | 46290 | C | 7/1939 |

OTHER PUBLICATIONS

ISA Korean Intellectual Property Office, International Search Report and Written Opinion Issued in Application No. PCT/US2013/069311, dated Feb. 11, 2014, WIPO, 11 pages.
United States Patent and Trademark Office, Restriction Requirement Issued in U.S. Appl. No. 14/076,007, dated Oct. 7, 2015, 8 pages.
United States Patent and Trademark Office, Office Action Issued in U.S. Appl. No. 14/076,007, dated Jan. 21, 2016, 7 pages.
United States Patent and Trademark Office, Office Action Issued in U.S. Appl. No. 14/076,007, dated Sep. 8, 2016, 12 pages.
European Patent Office, Extended European Search Report Issued in Application No. 13853805-3, dated Nov. 8, 2016, Germany, 10 pages.
Australian Patent Office, Office Action Issued in Application No. 2013342120, dated Nov. 18, 2016, 4 pages.
United States Patent and Trademark Office, Office Action Issued in U.S. Appl. No. 14/076,007, dated Feb. 28, 2017, 9 pages.
United States Patent and Trademark Office, Applicant—Initiated Interview Summary Issued in U.S. Appl. No. 14/076,007, dated Jun. 22, 2017, 3 pages.
European Patent Office, Extended European Search Report Issued in Application No. 17000089.7, dated Sep. 8, 2017, Germany, 9 pages.

* cited by examiner

FOOTWEAR ARTICLE HAVING CORD STRUCTURE

CROSS REFERENCE TO RELATED APPLICATIONS

The present application is a continuation of U.S. Non-Provisional patent application Ser. No. 15/410,676, entitled "FOOTWEAR ARTICLE HAVING CORD STRUCTURE", and filed on Jan. 19, 2017. U.S. Non-Provisional patent application Ser. No. 15/410,676 claims priority to U.S. Provisional Application No. 62/280,663, entitled "FOOTWEAR ARTICLE HAVING CORD STRUCTURE," and filed on Jan. 19, 2016. The entire contents of each of the above-listed applications are hereby incorporated by reference for all purposes.

BACKGROUND/SUMMARY

Footwear construction typically relies on the manipulation of flat materials into three-dimension shapes in order to form a footwear article. Cloth, leather, or other materials may be cut and sewn or otherwise attached and wrapped around a foot form to create a desired shape for the article, such as a footwear upper.

The Inventors have recognized several drawbacks with this traditional approach. For example, the material used to construct the upper may have only limited degrees of freedom in terms of flexibility, thereby limiting the ways in which the upper conforms to a wearer's foot and reducing comfort. As a result, even after the footwear is worn for a considerable amount of time, it may still not fully conform to the actual contours of the wearer's foot.

To at least partially address the above issues, the inventors herein have taken alternative approaches to footwear construction. In one example, a footwear article may include a looped upper with fibers or cords formed into a structure. In one example, the cords in the upper may be in slippable engagement with respect to one another and may be engaged at interfaces with an anchor cord. The anchor cord may be positioned at the upper away from and parallel to a sole of the footwear article. In this way, the cord structure can be tensioned independent of other upper materials, thereby enabling a more precise fit and increased functionality of the cord structure. Furthermore, a method for constructing the footwear article is simplified as the cord structure is anchored to the upper rather than directly to the sole.

BRIEF DESCRIPTION OF THE FIGURES

FIGS. 1-3 are shown to scale. However, other relative dimensions may be used if desired.

DETAILED DESCRIPTION

A footwear article constructed of cords is described herein. The footwear article may include interconnected bights in a cord structure providing a 3-dimensional form fitting construction. The cord structure increases the range of motion of an upper part of the footwear article while retaining flexibility and comfort. The cord structure may conform highly to the shape of a foot during use due to the relative movement provided by the bights. For example, by providing an array of bight interconnections across the upper from a lateral to medial side, and across a forefoot region, hundreds of adjustments, for example, can be automatically made by the cord structure so that the appropriate lengths of each cord section between the bights are achieved. As a result, the footwear's comfort is increased.

Further, the cord structure includes an anchor cord positioned away from and parallel to a sole of the footwear article. The remainder of the cord structure may be coupled to the anchor cord through an array of bight connections. In this way, the cord structure can be tensioned independent of other upper materials, thereby enabling a more precise fit and increased functionality of the cord structure. Furthermore, a method for constructing the footwear article is simplified as the cord structure is anchored to the upper rather than directly to the sole.

The example cord structures described herein also enable the manufacturing process of the footwear article to be simplified when compared to other types of shoe construction which use a foot form.

Figure 1:
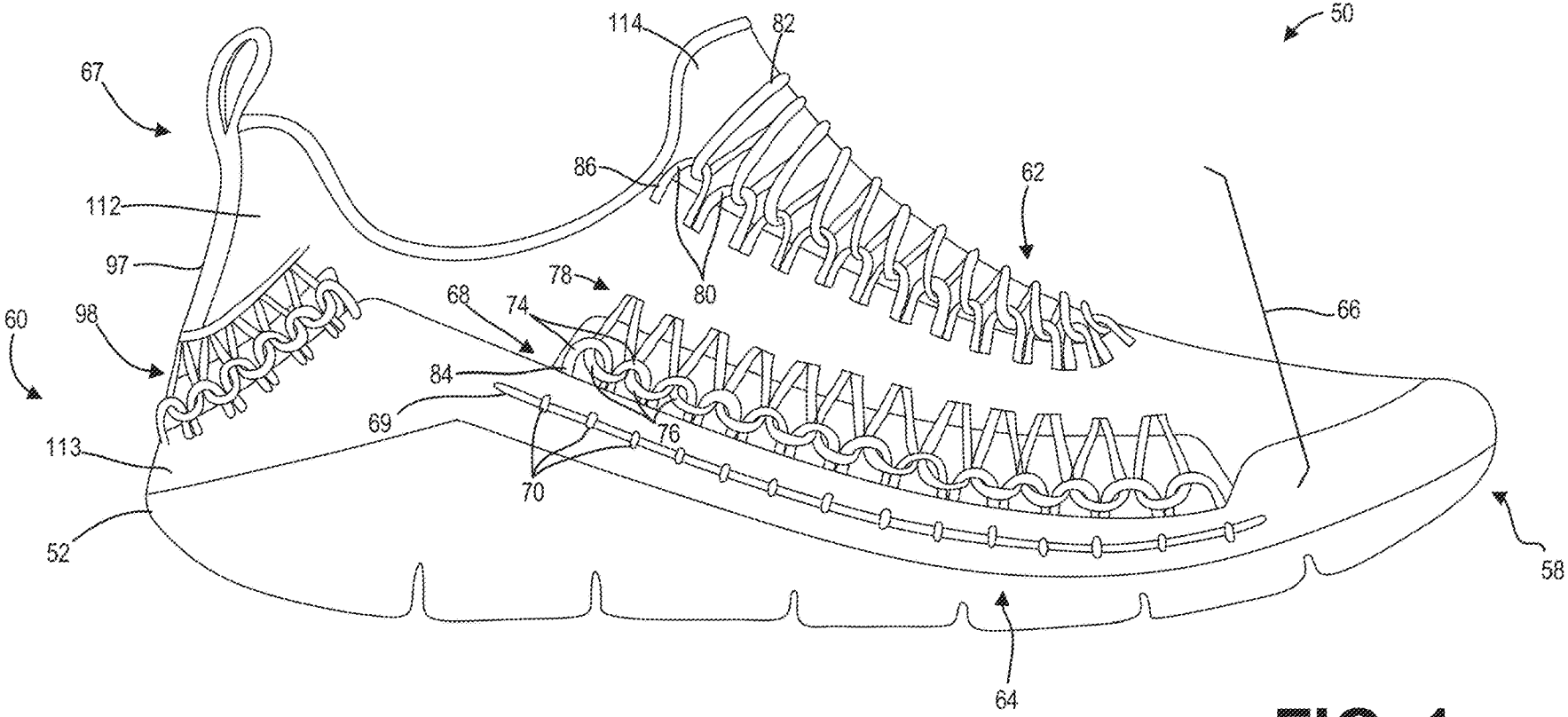
FIG. 1 shows a first example of a footwear article.

FIG. 1 shows an example footwear article 50. The footwear article 50 includes a sole 52. The sole 52 may be an insole/midsole, in one example. Thus, the insole and midsole may be single component in the footwear article. However, in other examples, the insole and midsole may be separate components in the footwear article. Further in one example, the footwear article 50 may also include an outsole. However, in other examples the footwear article 50 may not include an outsole or the outsole may be integrated into the sole 52.

The sole 52 is attached to an upper 67. Specifically, the upper 67 includes a first upper structure 112 and a second upper structure 113, and the sole 52 is attached to the second upper structure 113. The upper 67 further includes a cord structure 66. The cord structure may be formed from numerous cord sections interlocking with one another. The cord may include string, twine, yarn, rope, cable, strands of braided or twisted materials, and/or other cord-like structures including combinations of the previously listed examples twisted together or otherwise combined. In one example, the cord includes nylon cord of approximately a ⅛" diameter, with an outer sheath and inner twine. Of course, other sizing may also be used. In another example, the cord may be double braided nylon, with an inner braid filling a central void and an outer braid that may be of the same or different material. The cord may be flexible yet retain some of its shape in a free state. Further, the cord may have some elastomeric components. Further, different cord sections (e.g., the vamp as compared to the rand) may have different degrees of flexibility, elasticity, etc. In one example, different materials may be used in different sections of the cord structure 66. For instance, a more flexible type of cord may be used in an upper portion of the cord structure 66 and a less flexible type of cord may be used in a lower portion of the cord structure. Additionally, the portions of the cord structure coupled to the sole may be totally covered via the sole, in one example. In another example, the portions of the cord structure coupled to sole the may only be partially covered. For instance, portions of the cord structure proximate to the toes may be covered while portions of the cord structure, proximate to a heel, may be uncovered or vice-versa. Covering portions of the cord structure reduces the likelihood of premature wear of the cord caused by abrasions from rocks, dirt, and/or other particulates from the external environment. As a result, the footwear article's longevity is increased.

In one example, the cord structure 66 may include an anchor cord 69 which extends through openings in the second upper structure 113. As depicted, the anchor cord 69 is parallel to the sole 52. One or more cords in the cord structure 66 may include an array of anchor connection bights 70 which loop around the anchor cord 69 to facilitate coupling of the upper to the cord structure. Additionally or alternatively, a portion of the cord structure may be stitched, adhesively bonded (e.g., glued), and/or snapped into the upper to enable the coupling of the upper and the cord structure.

Thus, in the depicted example, the cord structure does not extend to the sole or midsole but is rather coupled to the second upper structure 113. It should be appreciated that in some examples, such as the examples described further herein with regard to FIG. 2, that the anchor cord may be attached to a midsole of the footwear article rather than the second upper structure 113.

In one example, the cord structure 66 may be a looped upper. In such an example, the looped upper may be formed in a grid-like pattern, but substantially free of knots at a plurality of the slippable interfaces positioned away from the sole 52.

The cord structure 66 may be an upper of the footwear article 50. The cord structure 66 may at least partially enclose a foot. The cord structure 66 includes a rand substructure 68. The rand substructure is coupled to the anchor cord 69. Specifically in one example, anchor attachment bights 70 in the rand substructure 68 may be coupled to and/or extend through the anchor cord 69. In one example, the attachment bights may be formed via a single cord in the rand substructure 68. Thus, a single cord may have multiple bights. A bight is a curved portion or section of a greater cord in the cord structure 66. Thus, a bight may be a portion of a loop in a cord.

The rand substructure 68 further includes vamp attachment bights 74. The vamp attachment bights 74 are coupled (e.g., interconnected, interlocked, stitched, intertwined, and/or slidingly engaged) to rand attachment bights 76 included in a vamp substructure 78 in the cord structure 66. The interconnection between the vamp attachment bights 74 and the rand attachment bights 76 forms a loop line. The loop line may be an interface between the rand substructure 68 and the vamp substructure 78. The loop line extends in a direction from a heel side 60 of the footwear article 60 to a toe side 58 of the footwear article. As shown, the loop line is also parallel to the anchor cord 69. The loop line also extends from a tibular side 62 of the footwear article 50 to a fibular side 64 of the footwear article. Similar to the anchor cord 69, the loop line may peripherally extend around the footwear article, and in one example may traverse around the entire upper. Further it will be appreciated that the loop line may extend in an arc around at least a portion of the footwear article 50. Other loop line configurations have been contemplated. For instance, the loop line may extend across the footwear article from a first lateral side to a second lateral side. Further in another example, the loop line may extend around the footwear article in an arc, from a first side of a heel counter to a second side of a heel counter. Still further in another example, the loop line may laterally extend across the footwear article as well as extend in an arc around a front of the footwear article (e.g., toe side). Even further in another example, the loop line may only extend around a portion of the footwear article, such as a portion adjacent to a toe side or a heel side of the footwear article. Further still in one example, the footwear article may include a plurality of loop lines.

The vamp substructure 78 is spaced away (e.g., vertically spaced away) from the sole 52, in the depicted example. Additionally, the rand substructure 68 may be positioned vertically above the sole 52 and the vamp substructure 78 may be positioned vertically above the rand substructure. It will be appreciated that other footwear article orientations may be used if desired. It will be appreciated that the vamp substructure 78 may be spaced away from the sole 52 when the footwear article is not being worn. The cord structure 66 may retain it shape due to the interconnection between the vamp substructure 78 and the rand substructure 68, along with the internal structure of the cord. Example interconnections are discussed in further detail herein.

It will be appreciated that the vamp attachment bights 74 are shown interlocked with rand attachment bights 76. In this way, the vamp substructure may be coupled to the rand substructure without the use of adhesive, if desired. Similarly, the anchor attachment bights 70 are shown interlocked with the anchor cord 69. In this way, the rand substructure may be coupled to the anchor cord without the use of adhesive. However, it will be appreciated that in some examples adhesives may be used to couple certain elements in the footwear article. In one example, the sliding connection between the bights may be free of knots. However in another example, at least a portion of the vamp attachment bights 74 may be fixedly coupled to at least a portion of the rand attachment bights 76. In another example, stitched locks may be used to provide the partially sliding interconnection. For instance, loose or tight stitched interfaces may be provided at the junctions of the cords in the upper. By controlling the amount of slippable engagement in various sections of the footwear article desired fitting characteristics may be achieved to increase the wearer's comfort.

The vamp substructure 78 further includes lace attachment bights 80. The lace attachment bights 80 are shown coupled to a lace cord 82. Specifically, the lace cord 82 extends through the lace attachment bights 80. The length of the lace cord 82 may be adjusted by the wearer. However, alternate lace cord configurations have been considered. For instance, the footwear article may be constructed without a lace cord. In this way, a wearer can quickly and easily slip on and off the footwear article without the need to tie a lace cord. In such an example, elastic material may be provided in the footwear article to enable controlled expansion and contraction of portions of the cord structure. Additionally, different lacing patterns have been considered. For instance, the cord structure may include eyestays. Cords in the cord structure may extend through the eyestays.

The lace cord 82 may be included in the cord structure 66, in some examples. However, in other examples the lace cord 82 may not be included in the cord structure 66. In such an example, elastic or other suitable material may be used to provide the footwear article with a slip-on capability.

Numerous relative vamp cord, rand cord, anchor cord, and/or lace cord lengths have been contemplated.

The cords of the cord structure 66 may be in slippable engagement with respect to one another. The cords may also be interlocked with one another. The slippable engagement may be formed at cord interfaces, the interfaces positioned along a loop line traversing across lateral and medial sides of the upper, and further across a forefoot and/or toe region. By providing a looped upper with cords slippable relative to one another in the upper, yet having reduced slip at an anchor cord, it is possible to retain a functional footwear article that retains to the wearer's foot, while enabling the upper to form fit to the wearer's foot. For example, the slip between the various cord interfaces enables each cord section between an interface to have a variable length so that the overall upper conforms to the actual shape of the wearer's foot. Thus, in some examples, a loop of one cord may be slippably engaged along an entire length of a second loop intertwined with the loop.

It should be appreciated that although described in regards to slippable interfaces, there may be some embodiments and/or portions of the upper where slippage is limited (controlled) and/or prevented as it may not, in some embodiments, be needed or necessary. For example, and not as a limitation, controlled slippage may be provided corresponding to a desired limitation on motion. For example, controlled slippage may be provided to address quick lateral movement where some slippage is provided but limited in distance and/or time. Further, in other embodiments, one or more regions of the upper may be configured for non-slippage, creating a more rigid, non-slip, or limited slip interface. As an example, the range of slippage may be controlled by one or more of the slippable interfaces, the length of the cord sections, and so on. Further, the type and position of the cord sections and interfaces may further be used to provide controlled slippage.

It should be appreciated, that the construction method described herein enables, in some embodiments, options for customizing sizing and for adjusting sizing with minimal tooling expenditures. For example, the construction of the upper based on a cord length enables variation in size without changing the upper pattern or obtaining different size cutting dies. As such, in some embodiments, the size of the upper can be altered by varying the cord length. The loops may remain in their relative position for each size. Such construction reduces costs by utilizing same size tooling.

Likewise, customization of the footwear may be applied to improve fit for a specific user. With generation of an electronic scan of a foot, a customized and personalized cord may be used to generate customized footwear based on the foot scan. For example, the lengthening (or shortening) of the loops, the positioning and sizing of the loop line, and the adjustment of cord size may be adjusted alone or in combination to tailor the upper to the specific dimensions of the scanned foot to provide a customized fit.

Turning back to FIG. 1, the rand cord 84 and the vamp cord 86 are depicted as being round cords in FIG. 1. However, other shapes have been contemplated. For instance, one or more of the cords may be flat cords or one or more of the cords may have flat ends and round midsections. In another example, one or more of the cords may have one or more flat sections and one or more round sections. For instance, a cord may include a round section followed by a flat section and so on and so forth. Additionally, the anchor cord 69 may be flat, round, or have different sections with varying geometries. Additionally, the rand cord 84, the vamp cord 86, and the lace cord 82 are all depicted as having a similar cross-sectional area (e.g., diameter) and/or geometry. In one example, the diameter of one or more of the cords may be between $\frac{1}{8}^{th}$ of an inch and $\frac{1}{16}^{th}$ of an inch. However, in other examples the cords may have varying widths. It will be appreciated that the anchor cord 69 may have a similar geometry to the rand cord, vamp cord, and/or lace cord, in one example. However, in other examples, the cross-sectional area and/or geometry of the rand cord 84, the vamp cord 86, anchor cord 69, and/or lace cord 82 may vary. For example, the cross-sectional area of the rand cord may be larger than the vamp cord. In another example, the rand cord may be circular and the vamp cord may be flat.

Further in some examples, the rand cord 84, vamp cord 86, and/or lace cord 82 may comprise similar material(s). However, in other examples the aforementioned cords may comprise different materials. One or more of the cords may comprise synthetic fibers such as Polypropylene, Nylon, Polyester, Polyethylene, Aramid, and/or Acrylate polymer. Additionally, one or more of the cords may comprise natural fibers such as cotton, linen, coir, etc. Further in one example, one or more of the cords may comprise a polymeric material.

Additionally, the rand cord 84, vamp cord 86, anchor cord 69, and/or lace cord 82 may be designed with different material properties to enable the footwear article have desired structural characteristics. For example, the lace cord 82 may have a greater elasticity than the rand cord 84 and/or the vamp cord 86.

As shown in FIG. 1, the vertical height of the vamp attachment bights increases in a reward direction extending toward the heel side 60 of the footwear article 50. The width of the interlocked vamp cord sections extending from the lace cord to the rand cord may also increase in the reward direction extending toward the heel side 60 of the footwear article 50.

The footwear article 50 also includes a heel counter 97. The heel counter or other support structures in the footwear article may be included in the upper discussed above. It will be appreciated that the rigidity/flexibility of the heel counter 97 may be selected to provide a desired amount of support to the cord structure 66. Specifically, the heel counter 97 may prevent the cord structure from flexing outward and/or downward in a direction toward the sole by an undesirable amount. In this way, the cord structure may maintain a desired shape. As a result, a wearer of the footwear article may quickly and comfortably put on and take off the footwear article. The heel counter 97 may comprise a different material than the cord structure 66, such as leather, synthetic leather, fabric, etc. However, in some examples the heel support structure may also comprise cord. The loop line may extend through the heel counter 97 in some examples. Additionally, the heel counter 97 may be coupled to the sole 52. Specifically, in some examples the heel counter structure may extend (e.g., vertically or angularly) from the sole 52. The heel counter 97 is coupled to the rand substructure 68, in the depicted example. Additionally, a portion of the cord structure may extend around the width of the heel counter 97. However, other heel counter configurations have been contemplated. In one example, ends of cords in the cord structure may be coupled to the heel counter and/or coupled to one another within the heel counter. In one example, the heel counter 97 may have greater stiffness in a longitudinal direction than a lateral direction. The vertical stiffening of the support may provide a desired amount of support to the cord structure. However, other heel counter 97 material characteristics have been contemplated.

Thus, in some examples, the footwear article 50 may optionally include a heel cord structure 98 which includes vamp and rand substructures. In such examples, the anchor cord 69 may extend around the heel side 60 of the footwear article 50, such that the rand substructure of the heel cord structure 98 may be attached thereto. It should be appreciated that in some examples, the heel cord structure 98 may not be included in the footwear article 50.

The footwear article 50 shown in FIG. 1 may further include an eyestay. Cords in the cord structure 66 may extend through the eyestay. It will be appreciated that more than one cord section extends though the eyestay. However in other examples, alternate eyestay designs have been contemplated. The eyestay may provide desired cord spacing and cord support to the cord structure. In this way, the eyestay may limit the free movement of the cords extending therethrough. The eyestay may be included in an upper structure 112. In one example, the upper structure 112 may be adjacent to a tongue 114 of the footwear article. The upper structure may comprise a different material than the cord structure, in one example. Example eyestay materials include cloth, leather, synthetic leather, fabric, polymeric material, etc. In other examples, the footwear article may include a plurality of eyestays.

Additionally, one or more sheaths may enclose (e.g., circumferentially enclose) a portion of at least one of the rand cord 84 and vamp cord 86, in some examples. Therefore, the sheaths may surround various sections of the cords in the cord structure. For instance, a plurality of sheaths may surround a portion of the rand cord 84 from vamp attachment bights 74 to the rand attachment bights 76. Thus, the sheaths may act as protective covers for the cords. In some examples, the sheath may be in face sharing contact with an outer surface of the cord. However, in other examples, the sheath may be spaced away from an outer surface of the cord. The sheaths may be cylindrical, in one example. However, other sheath geometries have been contemplated. Additionally, a plurality of sheaths may be used to form a toe cap around the toe side of the footwear article. The sheaths may provide increased structural integrity to desired areas of the cord structure 66, to enable the cord structure 66 to retain a desired shape. The sheaths may comprise a different material than the vamp cord and/or the rand cord. In one example, the sheaths may comprise a polymeric material. The sheaths may also protect the cords from damage.

The footwear article may be manufactured using a double lasted stroebel and string construction, which allows the various upper parts—the cord structure and the upper structures—to act independent of each other. These upper parts are integrated together by the laces at the lace attachment bights.

Figure 2:
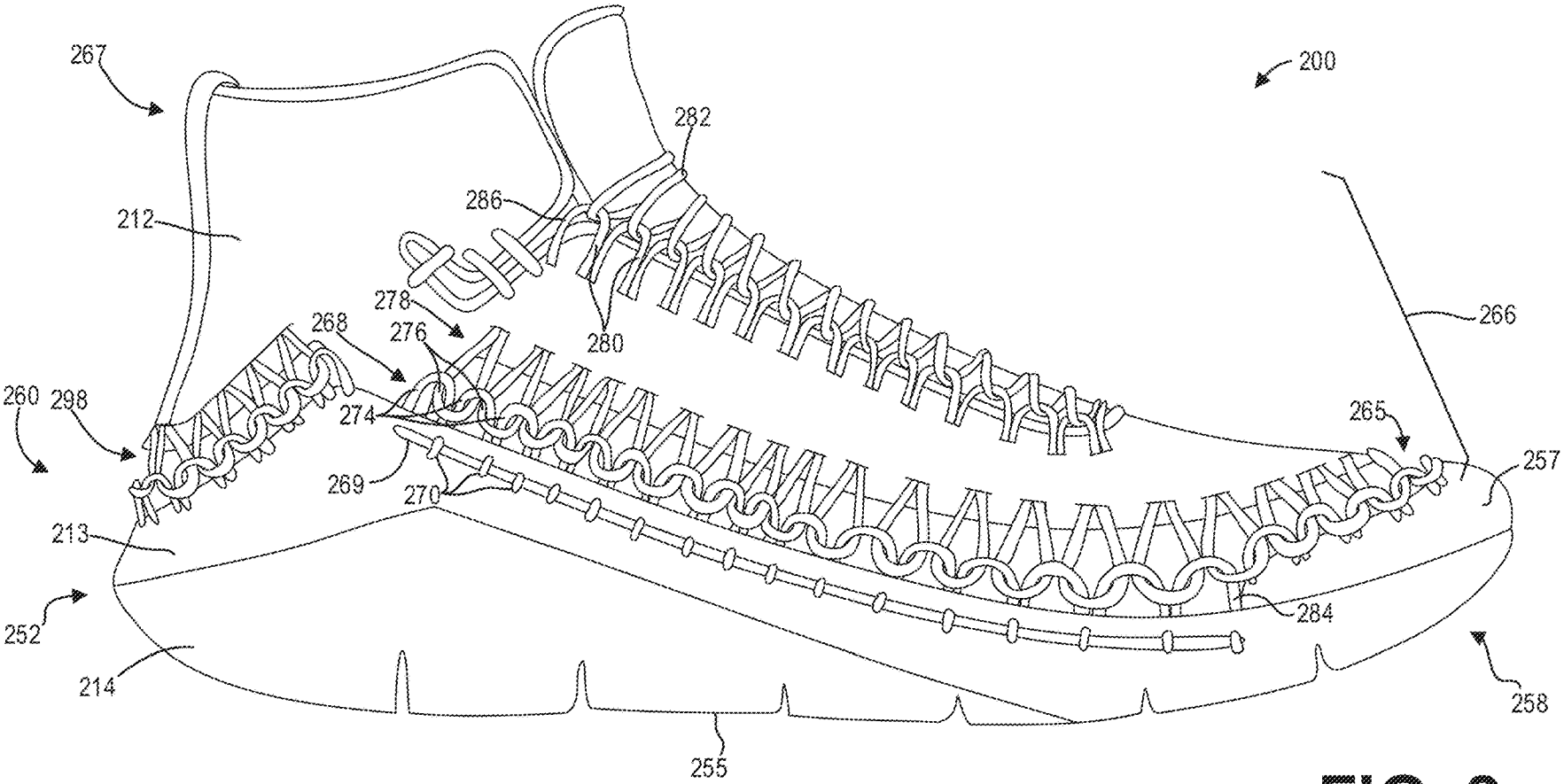
FIG. 2 shows a second example of a footwear article.

In some examples, the footwear article includes a single upper structure rather than a first and a second upper structure, as described herein above with regard to the footwear article 50 depicted in FIG. 1. Further, in some examples, the cord structure may extend around the toe side of the footwear article. As an illustrative example, FIG. 2 shows a profile view of a second example footwear article 200 wherein the cord structure 266 continues around the toe side 258 of the footwear article 200 rather than terminating at the toe cap 257. In contrast with the footwear article 50 described hereinabove with regard to FIG. 1, the footwear article 200 includes an upper 267 coupled to a sole 252 comprising a first sole structure 213 and a second sole structure 214.

As depicted, the upper 267 comprises an upper structure 212 or bootie and a cord structure 266. Similar to the first upper structure 112 and the second upper structure 113 of the footwear article 50, the upper structure 212 may be formed from fabric such as canvas or another suitable material.

Similar to the cord structure 66 of the footwear article 50, the cord structure 266 includes a rand cord 284, a vamp cord 286, and a lace cord 282. The rand cord 284 forms a rand substructure 268, while the vamp cord 286 forms a vamp substructure 278. The rand substructure 268 and the vamp substructure 278 are slippably-engaged and intertwined with each other via a plurality of vamp connection bights 274 and a plurality of rand attachment bights 276. The vamp cord 286 may further form a plurality of lace attachment bights 280 through which the lace cord 282 may be laced. The footwear article 200 may further include a second cord structure 298 positioned at the heel region 260 of the footwear article 200.

As illustrated, an anchor cord 269 traverses a portion of the first sole structure 213 of the footwear article 200, though it should be appreciated that the anchor cord may alternatively be coupled to a second upper structure as described above. Specifically, the anchor cord 269 follows a peripheral path around the first sole structure 213. The rand substructure 268 couples to the anchor cord 269 via a plurality of anchor connection bights 270.

Similar to the footwear article 50, the interconnection between the vamp attachment bights 274 and the rand attachment bights 276 forms a loop line. The loop line may be an interface between the rand substructure 268 and the vamp substructure 278. The loop line extends in a direction from a heel side 260 of the footwear article 200 to a toe side 258 of the footwear article. As shown, the anchor cord 269 is parallel to the loop line formed by the rand substructure 268 and the vamp substructure 278.

As depicted, the anchor cord 269 is not parallel to the bottom 255 of the sole 252. Instead, the anchor cord 269 is parallel to the loop line defined by the cord structure 266.

Although not explicitly shown, the anchor cord 269 may traverse the heel portion 260 of the footwear article 200 below the heel cord structure 298 such that the rand substructure of the heel cord structure 298 may be coupled to the anchor cord 269.

Further, the anchor cord 269 is coupled to the midsole of the footwear article 200. However, it should be appreciated that the anchor cord 269 may be coupled to the upper 267 rather than the midsole. The upper 267 of footwear article 200 includes one or more open spaces, such as the open space 265 between the upper 267 and the sole 252, traversed by at least a portion of the cord structure. By tightening the laces, the tension of the cord structure 266 may be adjusted.

In some examples, the anchor cord 269 may comprise the rand cord 284. That is, a portion of the rand cord 284 may be stitched through a portion of the footwear article such that the rand cord 284 forms the anchor cord 269, while the remainder of the rand cord 284 forms the rand substructure 268. In other examples, the anchor cord 269 may comprise a separate cord independent of the rand cord 284. Furthermore, in some examples, the footwear article may include at least two anchor cords, wherein one anchor cord is positioned on a medial side of the footwear article while another anchor cord is positioned on a lateral side of the footwear article.

Figure 3:
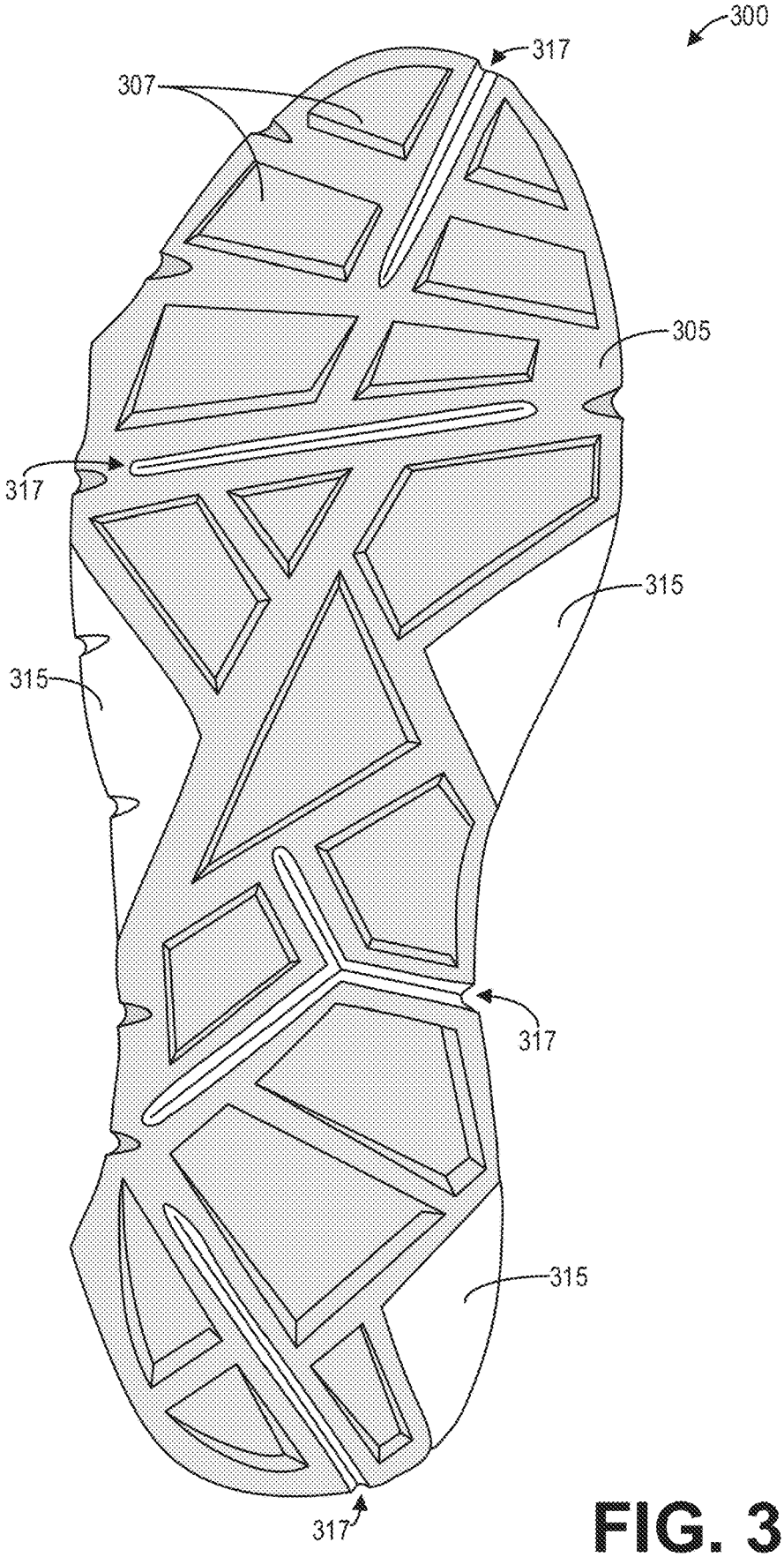
FIG. 3 shows an example sole of a footwear article.

FIG. 3 shows a bottom view of a sole 300 of an example footwear article such as the example footwear articles 50 or 200. The sole 300 may comprise different materials. As a non-limiting example, portion 315 of the sole 300 may comprise ethylene-vinyl acetate (EVA), while the portion 305 of the sole 300 may comprise rubber. In this way, the sole 300 enables a balance of urban and off-road performance as well as durability. The sole 300, in particular the portion 305 of the sole 300 formed from rubber, further includes a plurality of raised surfaces or treads 307. Furthermore, in some examples, the sole 300 may include a plurality of channels 317 in the portion 305 formed from rubber, which enable additional traction.

In one embodiment, a footwear article comprises: an upper, at least a portion of which is formed via one or more slippably-engaged and intertwined cords configured to at least partially enclose a foot, at least one of the cords engaged with an anchor cord traversing around a portion of the upper.

In a first example of the footwear article, the upper comprises one or more uninterrupted cords engaging with itself and/or one or more additional cords at a plurality of intertwined, yet at least partially slippably engaged at selected locations. In a second example of the footwear article optionally including the first example, the slippably engaged locations are positioned along one or more loop lines including the loop line traversing around a portion of the upper. In a third example of the footwear article optionally including one or more of the first and second examples, the anchor cord is parallel to the one or more loop lines. In a fourth example of the footwear article optionally including one or more of the first through third examples, the one or more intertwined cords are flexible to bend in any direction, yet retains its shape at least partially in a free-state. In a fifth example of the footwear article optionally including one or more of the first through fourth examples, the footwear article further comprises a sole coupled to the upper, wherein the anchor cord is positioned away from a bottom of the sole. In a sixth example of the footwear article optionally including one or more of the first through fifth examples, the footwear article further comprises a gap between at least a portion of the upper and the sole, wherein the one or more slippably-engaged and intertwined cords at least partially cover the gap, and wherein the anchor cord is parallel to the gap. In a seventh example of the footwear article optionally including one or more of the first through sixth examples, the anchor cord is not parallel to the sole. In an eighth example of the footwear article optionally including one or more of the first through seventh examples, the one or more slippably-engaged and intertwined cords are engaged with the anchor cord via a plurality of anchor connection bights formed by the one or more slippably-engaged and intertwined cords. In a ninth example of the footwear article optionally including one or more of the first through eighth examples, a first cord of the one or more slippably-engaged and intertwined cords forms a first plurality of loops and a second cord of the one or more slippably-engaged and intertwined cords forms a second plurality of loops, wherein a first loop of the first plurality of loops is intertwined with and slidably movable relative to at least two loops of the second plurality of loops, wherein a second loop of the at least two loops is intertwined with and slidably movable relative to at least two loops of the first plurality of loops including the first loop.

In another embodiment, a footwear article comprises: a sole; and an upper coupled to the sole, the upper comprising a fabric structure and a cord structure, the cord structure comprising at least two cords intertwined with each other via a plurality of loops to form a loop line, one cord of the at least two cords of the cord structure engaged with an anchor cord parallel to the loop line.

In a first example of the footwear article, the anchor cord is stitched through the fabric structure of the upper. In a second example of the footwear article optionally including the first example, the anchor cord comprises the one cord of the at least two cords of the cord structure engaged with the anchor cord. In a third example of the footwear article optionally including one or more of the first and second examples, the anchor cord extends peripherally around at least a portion of the upper. In a fourth example of the footwear article optionally including one or more of the first through third examples, the anchor cord is positioned on a medial side of the upper, and further comprising a second anchor cord positioned on a lateral side of the upper and engaged with at least one cord of the cord structure. In a fifth example of the footwear article optionally including one or more of the first through fourth examples, a first portion of the sole is formed from ethylene-vinyl acetate and a second portion of the sole is formed from rubber.

In yet another embodiment, a footwear article comprises: a looped upper with cords forming a structure configured to enclose a foot, the cords in the upper in slippable engagement with respect to one another, one of the cords further engaged with an anchor cord positioned away from and not parallel to a bottom of a sole coupled to the upper, wherein a first cord of the cords forms a first plurality of loops and a second cord of the cords forms a second plurality of loops, wherein a loop of the first plurality of loops is in slippable engagement with at least two loops of the second plurality of loops, and wherein a loop of the second plurality of loops is in slippable engagement with at least two loops of the first plurality of loops.

In a first example of the footwear article, the slippable engagement is formed at cord interfaces, the cord interfaces positioned along a loop line traversing across lateral and medial sides of the upper, and further across at least one of a forefoot and a toe region, wherein the cord interfaces comprise a first loop intertwined with and slidably movable with respect to a second loop, the first loop and the second loop formed from the cords. In a second example of the footwear article optionally including the first example, the looped upper is formed in an intertwined pattern, but substantially free of knots at a plurality of slippable interfaces positioned away from the sole. In a third example of the footwear article optionally including one or more of the first and second examples, the footwear article further comprises a bootie at least partially enclosed by the one or more slippably-engaged and intertwined cords.

It will be appreciated that the configurations and/or approaches described herein are exemplary in nature, and that these specific embodiments or examples are not to be considered in a limiting sense, because numerous variations are possible. For example, the above technology can be applied to various types of footwear, such as boots and dress shoes. In another example, the technology can be applied to men's, women's, and children's footwear. Further, the technology can be applied to water-submersible shoes. The subject matter of the present disclosure includes all novel and nonobvious combinations and sub-combinations of the various features, functions, acts, and/or properties disclosed herein, as well as any and all equivalents thereof.

The following claims particularly point out certain combinations and sub-combinations regarded as novel and nonobvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A footwear article, comprising:

an upper, at least a portion of which is formed via two or more slippably-engaged and intertwined cords configured to at least partially enclose a foot, wherein the two or more slippably-engaged and intertwined cords form a loop line extending around the upper from a medial side to a lateral side, and wherein one cord of the two or more slippably-engaged and intertwined cords is engaged with an anchor cord traversing a portion of the upper, wherein the anchor cord is parallel to at least a portion of the loop line and positioned in the upper.

2. The footwear article of claim 1, wherein one of the two or more slippably-engaged and intertwined cords engages with another cord of the two or more slippably-engaged and intertwined cords at a plurality of selected locations.

3. The footwear article of claim 2, wherein the plurality of selected locations is positioned along the loop line including the loop line traversing around a portion of the upper.

4. The footwear article of claim 1, wherein the upper further comprises a fabric component, wherein the anchor cord is stitched through the fabric component, and wherein the one cord engages the anchor cord at an exterior surface of the fabric component.

5. The footwear article of claim 1, wherein the two or more slippably-engaged and intertwined cords are flexible to bend in any direction, yet retains their shape at least partially in a free-state.

6. The footwear article of claim 1, further comprising a sole coupled to the upper, wherein the anchor cord is positioned away from a bottom of the sole.

7. The footwear article of claim 6, further comprising an open space between at least a portion of a fabric component of the upper and the sole, wherein the two or more slippably-engaged and intertwined cords at least partially cover the open space, and wherein the anchor cord is parallel to the open space.

8. The footwear article of claim 6, wherein the anchor cord is not parallel to the sole.

9. The footwear article of claim 1, wherein the two or more slippably-engaged and intertwined cords are engaged with the anchor cord via a plurality of anchor connection bights formed by the one cord of the two or more slippably-engaged and intertwined cords.

10. The footwear article of claim 1, wherein a first cord of the two or more slippably-engaged and intertwined cords forms a first plurality of loops and a second cord of the two or more slippably-engaged and intertwined cords forms a second plurality of loops, wherein a first loop of the first plurality of loops is intertwined with and slidably movable relative to at least two loops of the second plurality of loops, wherein a second loop of the at least two loops is intertwined with and slidably movable relative to at least two loops of the first plurality of loops including the first loop.

11. A footwear article, comprising:

a sole;

an upper coupled to the sole, the upper comprising a cord structure, the cord structure comprising at least two cords intertwined with each other via a plurality of loops to form a loop line, a first cord of the at least two cords of the cord structure engaged with an anchor cord, the anchor cord parallel to the loop line and positioned below the loop line, the upper further comprising a lace cord laced through lace loops formed by a second cord of the at least two cords.

12. The footwear article of claim 11, wherein the upper further comprises a fabric structure, wherein the anchor cord is stitched through the fabric structure of the upper.

13. The footwear article of claim 12, wherein the one cord is stitched through the fabric structure to form a plurality of loops around the anchor cord at selected locations along the anchor cord.

14. The footwear article of claim 11, wherein the anchor cord extends peripherally around at least a portion of the upper.

15. The footwear article of claim 11, wherein the anchor cord is positioned on a medial side of the upper, and further comprising a second anchor cord positioned on a lateral side of the upper and engaged with at least one cord of the cord structure.

16. The footwear article of claim 11, wherein the upper further comprises a second cord structure positioned at a heel of the upper, the second cord structure comprising at least two cords intertwined with each other via a second plurality of loops.

17. A footwear article, comprising:

a looped upper with cords forming a structure configured to enclose a foot, the cords in the upper in slippable engagement with respect to one another, a first cord of the cords further engaged with an anchor cord positioned away from a sole coupled to the upper, wherein the first cord of the cords forms a first plurality of loops and a second cord of the cords forms a second plurality of loops, wherein a loop of the first plurality of loops is in slippable engagement with at least two loops of the second plurality of loops, and wherein a loop of the second plurality of loops is in slippable engagement with at least two loops of the first plurality of loops, wherein the slippable engagement of the first plurality of loops and the second plurality of loops forms a loop line parallel to the anchor cord, the anchor cord positioned at the upper between the loop line and the sole, wherein the first cord forms a third plurality of loops engaged with the anchor cord.

18. The footwear article of claim 17, wherein the slippable engagement is formed at cord interfaces, the cord interfaces positioned along the loop line traversing across lateral and medial sides of the upper, and further across at least one of a forefoot and a toe region, wherein the cord interfaces comprise a first loop intertwined with and slidably movable with respect to a second loop, the first loop and the second loop formed from the cords.

19. The footwear article of claim 17, wherein the looped upper is formed in an intertwined pattern at a plurality of slippable interfaces positioned away from the sole.

20. The footwear article of claim 17, further comprising a bootie at least partially enclosed by the structure.

* * * * *